US006131603A

United States Patent [19]

Takano et al.

[11] Patent Number: 6,131,603

[45] Date of Patent: Oct. 17, 2000

[54] TI ALLOY POPPET VALVE AND SURFACE TREATMENT THEREOF

[75] Inventors: Yuji Takano; Hiroaki Asanuma, both of Fujisawa; Ryousuke Hada, Atsugi; Masahito Hirose, Hayama-machi, all of Japan

[73] Assignee: Fuji Oozx Inc., Japan

[21] Appl. No.: 09/411,285

[22] Filed: Oct. 4, 1999

[30] Foreign Application Priority Data

Aug. 10, 1999 [JP] Japan ..... 11-226652
Sep. 3, 1999 [JP] Japan ..... 11-249549

[51] Int. Cl.[7] ..... F16L 7/00

[52] U.S. Cl. ..... 137/375; 251/368; 123/188.3

[58] Field of Search ..... 251/368; 123/188.3; 137/375

[56] References Cited

U.S. PATENT DOCUMENTS

| | | | |
|---|---|---|---|
| 5,370,364 | 12/1994 | Kenmoku et al. | 251/368 |
| 5,441,235 | 8/1995 | Narasimhan et al. | 251/368 |
| 5,662,745 | 9/1997 | Takayama et al. | 148/237 |

*Primary Examiner*—A. Michael Chambers
*Assistant Examiner*—Thomas L. McShane
*Attorney, Agent, or Firm*—Zarley, McKee, Thomte, Voorhees & Sease

[57] ABSTRACT

A poppet valve in an internal combustion engine of a vehicle consists of a valve body which comprises a valve stem and a valve head at one end of the valve stem. An oxidized layer is formed on portions of the valve body which contacts another valve-operating member. On the oxidized layer, a carburized layer is formed to cover the whole surface to increase wear resistance and fatigue strength of the valve.

15 Claims, 2 Drawing Sheets

TI ALLOY POPPET VALVE AND SURFACE TREATMENT THEREOF

BACKGROUND OF THE INVENTION

The present invention relates to a Ti alloy poppet valve which provides improved wear resistance and strength, and surface treatment thereof.

The largest difficulty for increasing allowable rotation speed of an engine is increase in inertial mass owing to increase in weight of valve-operating parts. If whole weight of the valve-operating parts increases, followability of a valve body to a cam decreases owing to inertial mass during high-speed rotation so as to decrease engine output performance.

Therefore, a poppet valve is molded from a low-density heat resistant Ti alloy to decrease its weight instead of a conventional heat resistant steel. However, Ti alloy has activity and is likely to adhere to another metal. Wear resistance and fatigue strength are not sufficient. Surface treatment such as nitriding and Ni plating is made on the surface of Ti alloy valve to improve wear resistance.

The nitrided valve provide high strength or hardness and wear resistance, but it is too rigid, so that it is likely to attack other parts. It is required to replace material of another valve-operating member which contacts the valve to increase manufacturing cost. A Ni plated valve does not achieve sufficient heat resistance and is not suitable as an exhaust valve.

SUMMARY OF THE INVENTION

In view of the disadvantages, it is a primary object of the present invention to provide a Ti alloy poppet valve which improves wear resistance and strength without nitriding or plating.

It is another object of the invention to provide a method of surface treatment of the poppet valve.

BRIEF DESCRIPTION OF THE DRAWINGS

The features and advantages of the invention will become more apparent from the following description with respect to embodiments as shown in attached drawings wherein.

DETAILED DESCRIPTION OF PREFERRED EMBODIMENTS

Figure 1:
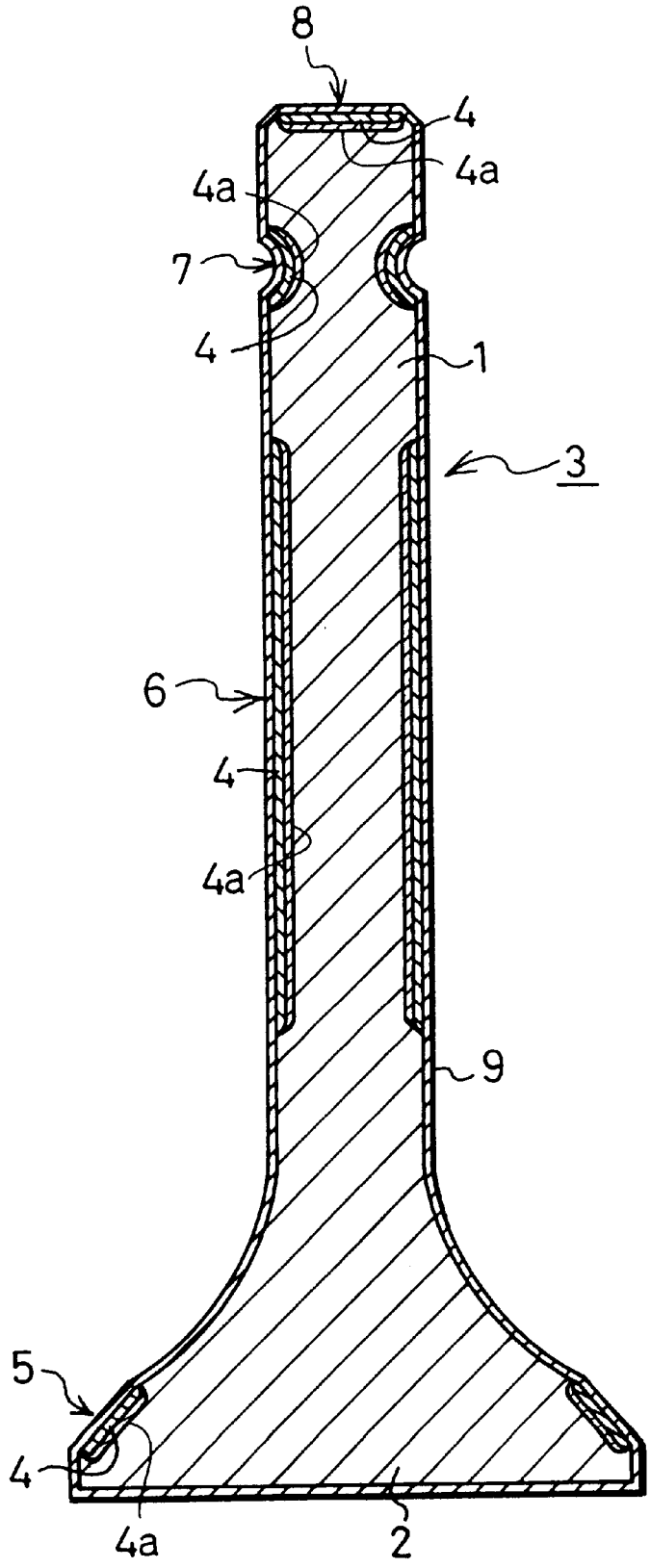
FIG. 1 is a central vertical sectioned front view of a poppet valve according to the present invention.

FIG. 1 illustrates a Ti alloy poppet valve. A valve body 3 which comprises a valve stem 1 and a valve head 2 at the lower end is molded from Ti—Al alloy such as a phase Ti—5Al—2.5Sn alloy, ($\alpha$+$\beta$) phase Ti—6A1—4V alloy or Ti—6Al—2Sn—4Zr—2Mo alloy made of ($\alpha$+$\beta$) phase which contains a small amount or less than 10% $\beta$ phase (Near $\alpha$).

An oxidized layer 4 which contains $TiO_2$ and has thickness of 10 to 15 $\mu$m is formed on the surface of parts which requires high wear resistance and fatigue strength, such as a valve face 5 which contacts a valve seat, an intermediate part 6 of the valve stem 1 which is slidably engaged in a valve guide, an annular groove 7 on which a cotter is engaged, and an end face 8 on which a rocker arm or a tappet is engaged. A boundary layer 4*a* between the oxidized layer 4 and the valve body 3 has needle crystal structure.

The oxidized layer 4 is formed by heating the surface of the propane and a natural gas to a predetermined temperature to oxidize the surface layer. The oxidized layer 4 may be formed by a high frequency induction heater.

After the oxidized layer 4 is formed, a carburized layer 9 which contains Ti and has thickness of 3 to 5 $\mu$m is formed by carburizing on the whole surface of the valve body 3. The carburized layer 9 is formed by heating the surface of the valve body 3 at temperature of less than transformation point such as 800° C. by a high density energy heater such as plasma, laser and electronic beam and diffusing carbons by gas carburizing.

The high density energy heater such as plasma locally heats only the surface for a short time to prevent heat from transferring to the inside, thereby preventing changing of the material of the valve body 3 not to decrease fatigue strength. It is also advantageous in reducing carburizing time.

The carburized layer 9 may be formed, and then the oxidized layer 4 may be formed therein. In this case, oxidization is carried out by an acetylene gas to diffuse carbons in the gas into the material, thereby promoting in the oxidization step.

As carried out by the foregoing embodiment, the valve body 3 is made of Ti—Al alloy, or $\alpha$ phase, ($\alpha$+$\beta$) phase or ($\alpha$+$\beta$) phase which contains a small amount of $\beta$ phase and the carburized layer 9 is formed on the surface, so that the valve body 3 is strengthened with advantage of equiaxed structure of the valve body 3 to increase tension ductility and fatigue strength. By forming only the carburized layer 9, fatigue strength is increased by about 20%.

Furthermore, the oxidized layer 4 is formed in the parts of the valve face 5 which contacts another valve-operating member, and the boundary layer 9*a* therebelow is partially organized to a needle crystal structure, thereby increasing wear resistance and toughness of the surface layer significantly without decreasing fatigue strength of the whole valve body 3.

The oxidized layer 9 is not too rigid as compared with a conventional nitriding, so that aggressiveness to another valve-operating member does not increase.

The inventors makes samples the surface of which was treated and a wear test is carried out to the samples. A wear tester and how to examine will be described.

Figure 2:
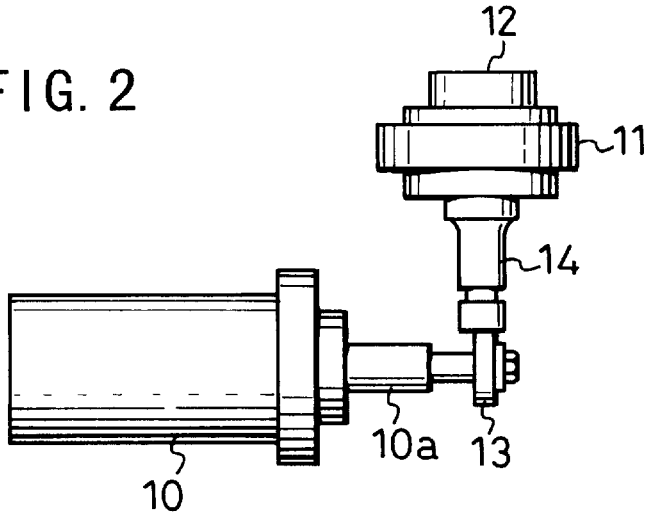
FIG. 2 is a front elevational view of a wear tester.

FIG. 2 illustrates a Crossbar tester which comprises a motor 10, a sample fixing jig 11 which moves up and down just above the end of a shaft 10*a* of the motor 10 and a weight 12 on the fixing jig 11.

At the end of the shaft 10*a*, a disc-shaped steel chip 13 which is ground at the outer circumferential surface and treated with oil extraction is concentrically mounted. Then, on the lower surface of the fixing jig 11, a sample 14 which is treated with oil extraction and has a flat lower end face is mounted, and the lower end face is engaged on the upper surface of the chip 13. A 1 kg weight 12 is put on the upper surface of a fixing jig 11, and a motor 10 is operated to rotate the chip 13 at fixed speed. A weight is added by 500 g every time the chip 13 slides on the sample 14 by 50 m which is determined by rotation of the motor and an outer diameter of the chip.

The test is finished when seizure and galling occurs between the sample 14 and the chip 13 or when sliding distance reaches to 350 m.

Figure 3:
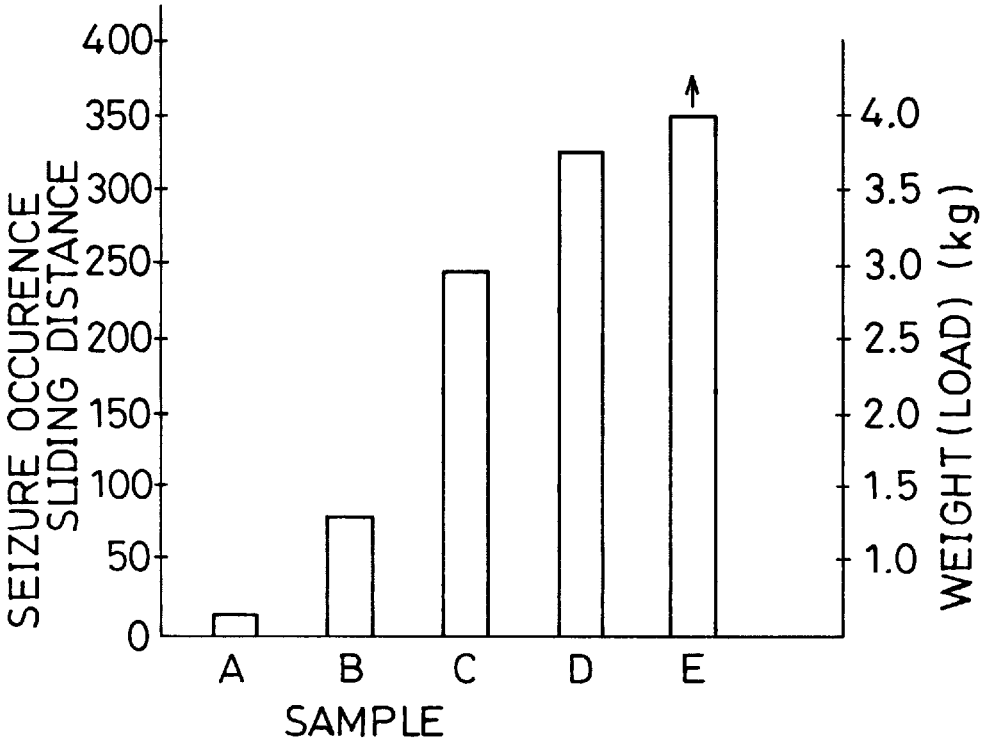
FIG. 3 is a graph which shows the results a test.

The results of the test are shown in FIG. 3. The sample "A" denotes an ordinary Ti—Al alloy which is not hardened on the surface; "B" denotes Ti—6Al—4V alloy on which a carburized layer is formed; "C" denotes Ti—6Al—2Sn—4Zr—2Mo alloy on which a carburized layer is formed; "D" denotes one which has further an oxidized layer in "B"; and "E" denotes one which has further an oxidized layer in "C."

As shown in FIG. 3, in seizure occurrence distance, the samples "B" and "C" which have only carburized layer is better than non-hardened sample "A", and the samples "D" and "E" which have oxidized layer on the samples "B" and "C" are greatly better. Especially, the sample "E", Ti—6Al—2Sn—4Zr—2Mo, has no seizure even if it slides by 350 m, to provide significant high wear resistance.

As described above, in the present invention, the oxidized layer 4 is formed only on parts which are engaged with another valve-operating member to form needle crystal structure, and the carburized layer 9 is formed on the whole surface of the valve body 3 to improve wear resistance and fatigue strength totally. Thus, without decreasing fatigue strength of the valve body 3 itself, wear resistance and toughness of the surface layer can be improved.

It is considered that the valve body 3 is directly oxidized on the surface, but it is difficult to obtain the above oxidized layer owing to reflection rate of the surface, and treatment time must be extended. Thus, heated area increases, and needle crystal structure increases to decrease fatigue strength of the valve body.

Before oxidization, a carbon spray film used in a laser beam processing may be applied to the surface of the valve body 3. So formed even if the carburized layer 9 is thin.

The present invention is not limited to the foregoing embodiments. In the foregoing embodiment, the oxidized layer 4 is formed on part which contacts another valve-operating member and the lower boundary layer 4*a* is formed as needle crystal structure. But only the oxidized layer 4 may be formed without such needle crystal structure.

In the foregoing embodiments, the valve body 3 is made of Ti alloy which comprises α phase, (α+β) phase, or (α+β) phase which contains a little amount of β phase, but Ti alloy which comprises β phase may be used.

Various modifications and changes may be made by person skilled in the art without departing from the scope of claims wherein:

What is claimed is:

1. A Ti alloy poppet valve which consists of a valve body which comprises a valve stem and a valve head at an end of said valve stem, an oxidized layer being formed on part of the valve body which contacts another valve-operating member, a carburized layer being formed on said oxidized layer on a surface of the valve body which requires wear resistance and fatigue strength.

2. A Ti alloy poppet valve as claimed in claim 1 wherein said another valve-operating member comprises a rocker arm, a tappet, a cam, a cotter, a valve guide or a valve seat.

3. A Ti alloy poppet valve as claimed in claim 1 wherein the carburized layer is formed on the whole surface of the valve body.

4. A Ti alloy poppet valve as claimed in claim 1 wherein a needle crystal structure is formed under the oxidized layer.

5. A Ti alloy poppet valve as claimed in claim 1 wherein said valve body is made of Ti alloy which comprises α phase, (α+β) phase or (α+β) phase which contains a small amount of β phase.

6. A method of treating a surface of a Ti alloy poppet valve which consists of a valve body, said method comprising, heating a surface of the valve body which contacts another valve-operating member under oxygen atmosphere to form an oxidized layer; and heating a surface of the valve body which requires wear resistance and fatigue strength at temperature less than transformation point to carry out carburizing to form a carburized layer.

7. A method of treating a surface of a Ti alloy poppet valve which consists of a valve body, said method comprising, heating a surface of the valve body which requires wear resistance and fatigue strength at temperature less than transformation point to carry out carburizing to form a carburized layer; and heating a surface of the valve body which contacts another valve-operating member under oxygen atmosphere to form an oxidized layer.

8. A method as claimed in claim 6 wherein said carburizing is gas carburizing.

9. A method as claimed in claim 6 wherein said another valve-operating member comprises a rocker arm, a tappet, a cam, a cotter, a valve guide or a valve seat.

10. A method as claimed in claim 6 wherein the carburized layer is formed on the whole surface of the valve body.

11. A method as claimed in claim 6 wherein a needle crystal structure is formed under the oxidized layer.

12. A method as claimed in claim 6 wherein said valve body is made of Ti alloy which comprises α phase, (α+β) phase or (α+β) phase which contains a small amount of β phase.

13. A method as claimed in claim 6 wherein cariburizing is carried out by a high density energy heater.

14. A method as claimed in claim 6 wherein said high density energy heater comprises plasma, laser or electronic beam.

15. A method as claimed in claim 6 wherein said oxidized layer is formed by flame which contains oxygen.

* * * * *